United States Patent [19]

Suzuki et al.

[11] 4,172,172

[45] Oct. 23, 1979

[54] NONWOVEN FABRIC OF THREE DIMENSIONAL ENTANGLEMENT

[75] Inventors: Seigi Suzuki; Toshio Yoshihara, both of Ohtake, Japan; Masayoshi Fujizaki, deceased, late of Fukuoka, Japan, by Yasugoro Fujizaki, Tomoo Fujizaki, successors

[73] Assignee: Mitsubishi Rayon Co., Ltd., Tokyo, Japan

[21] Appl. No.: 771,803

[22] Filed: Feb. 24, 1977

[30] Foreign Application Priority Data

Feb. 25, 1976 [JP] Japan ..... 51-19710

[51] Int. Cl.[2] ..... D04H 13/00

[52] U.S. Cl. ..... 428/224; 28/104; 428/288; 428/332; 428/369

[58] Field of Search ..... 28/104; 428/224, 227, 428/229, 280, 288, 296, 300, 332, 369

[56] References Cited

U.S. PATENT DOCUMENTS

| | | | |
|---|---|---|---|
| 2,908,064 | 10/1959 | Lauterbach et al. | 428/300 |
| 2,958,113 | 11/1960 | Lauterbach | 428/300 |
| 3,493,462 | 2/1970 | Bunting et al. | 428/300 |
| 3,494,821 | 2/1970 | Evans | 162/115 |
| 3,560,326 | 2/1971 | Bunting et al. | 28/104 |

*Primary Examiner*—James J. Bell

*Attorney, Agent, or Firm*—Oblon, Fisher, Spivak, McClelland & Maier

[57] ABSTRACT

A nonwoven fabric having no pattern and composed of 100% synthetic fibers, wherein individual fibers are held together by three-dimensional entanglement into a stabilized sheet form without being subjected to any bonding treatment, which nonwoven fabric has a structure characterized by a specific volume of the nonwoven fabric of 3.5 $cm^3/g$ or less, a bending index (in terms of R) of individual fibers of 4.0 or more, and a strength efficiency (in terms of S) of the nonwoven fabric of 90% or more. Such a nonwoven fabric has excellent properties which are comparable to conventional woven fabrics in not only hand but also practical performance characteristics. This nonwoven fabric is manufactured by a method which comprises placing on a substantially smooth supporting member a web, 35 to 170 $g/m^2$ in basis weight, composed of highly shrinkable synthetic fibers having a potential heat shrinkage of 50% or more, exposing said web to the impact of fine jet streams of water discharged under a pressure of 10 to 35 $kg/cm^2$, whereby allowing individual fibers to entangle one another, thereafter subjecting the web to wet heat treatment at free length conditions to allow the web to shrink by 50% or more in area, drying the shrunk web at a temperature at which no change takes place in the shape and internal structure of individual fibers, and then subjecting the dried web to heat setting under an applied pressure of 200 $g/cm^2$ or more.

6 Claims, 4 Drawing Figures

NONWOVEN FABRIC OF THREE DIMENSIONAL ENTANGLEMENT

Figure 1:
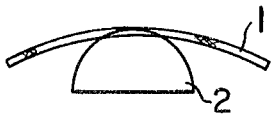

This invention relates to a nonwoven fabric having performance characteristics closely resembling those of a woven fabric and to a method for manufacturing the same.

Nonwoven sheet materials having varied properties have heretofore been proposed and several of them are in actual use. However, no conventional nonwoven sheet materials can match woven or knitted fabrics in practical performance characteristics such as air permeability, strengths, laundering resistance, etc., not to speak of characteristics and hand. Accordingly, the application fields where nonwoven materials can substitute for knitted or woven fabrics have been considerably limited so far. It has become widely known fact that among them, conventional nonwoven fabrics with adhesive bonds or melt fiber bonds cannot be imparted with the hand and other properties comparable to those of knitted or woven fabrics because of fixed bonds and the presence of non-fibrous substances such as an adhesive or melt bonded points.

There have been known and put to practice several methods such as stitch bonding, needle punching, and treatment with high-impact-pressure liquid streams which permit of forming sheet materials by entanglement of individual fibers without use of bonding treatments, but, in fact, the sheet materials produced by such methods have not been actually used as conventional woven fabrics, because they still lack the fabric attributes, hand, and other performances characteristic of woven fabrics. The reasons for this are the fundamental difference that the constructional unit of nonwoven fabrics is fiber as contrasted to yarn in the case of woven fabrics and, in addition, the differences in other fabric attributes such as basis weight, thickness, and specific volume, which are often apt to be overlooked. For instance, the basis weight of conventional woven fabrics is in the range of 150 to 500 g/m$^2$, whereas that of practical nonwovens made by stitch bonding or needle punching is in the range of about 400 to about 800 g/m$^2$, a basis weight range quite different from that of cloth customarily used in garments. This is because the basis weight is closely connected with the method of forming nonwoven fabrics and if a nonwoven fabric is made to conform to the basis weight requirement for the garment cloth, other fabric properties are apt to become so inferior that it is difficult to obtain a nonwoven sheet with practical utility. In addition to such a difference in basis weight, there is another difference in more important specific volume which is one of the fabric characteristics depending upon the structure of sheet material. The specific volume is calculated by the following equation from the basis weight and thickness measured according to the method of JIS L 1004.

$$\text{Specific volume (cm}^3\text{/g)} = \frac{\text{Thickness (cm)}}{\text{Basis weight (g/cm}^2\text{)}}$$

General woven fabrics have a specific volume in the range of 2 to 3 cm$^3$/g, whereas all the specific volumes of sheet materials made by stitch bonding, needle punching, and water jet treatment are 7 cm$^3$/g or more.

The specific volume so large as stated above of nonwoven sheet materials prepared by fiber entanglement means that the sheet is bulky and contains a large amount of vacancy among fibers constituting the sheeting, that is to say that the degree of fiber entanglement is insufficient, leaving room for further intensification of entanglement.

The present invention originates from the results of a great number of repeated trials in order to bring the aforesaid two fabric characteristics to levels comparable to those of a woven fabric. Further efforts have led to the invention of the present nonwoven fabric which has not only such hand characteristics as steady feeling in handling and desirable drape, but also excellent practical performances such as strengths, air permeability, and laundering resistance which are comparable to those of ordinary woven fabrics.

Thus, an object of this invention is to provide a nonwoven fabric which embodies improvement of fundamental defects of the conventional nonwoven fabrics and which is excellent in properties including not only the above-said hand characteristics, but also various practical performance characteristics.

Another object of this invention is to provide a method together with various conditions for manufacturing the above-noted excellent nonwoven fabric.

According to this invention there are provided (1) a non-patterned nonwoven fabric composed of synthetic fiber, preferably 100% polyester fiber, wherein individual fibers are held together by three-dimensional entanglement into a stabilized sheet form without being subjected to any bonding treatment, which nonwoven fabric has a structure characterized by a specific volume of the nonwoven fabric of 3.5 cm$^3$/g or less, a bending index (in terms of R) of individual fibers of 4.0 or more, and a strength efficiency (in terms of S) of the nonwoven fabric of 90% or more, the basis weight of said nonwoven fabric being preferably 100 to 520 g/m$^2$; and (2) a method for manufacturing said nonwoven fabric, which comprises placing on a substantially smooth supporting member a web, 35 to 170 g/m$^2$ in basis weight, composed of highly shrinkable synthetic fiber having a potential heat shrinkage of 50% or more, exposing said web to the impact of fine jet streams of water discharged under a pressure of 10 to 35 kg/cm$^2$, thereby allowing individual fibers to entangle one another, thereafter subjecting the web to wet heat treatment at free length conditions to allow the web to shrink by 50% or more in area, drying the web at a temperature at which no change takes place in the shape and internal structure of individual fibers, and then subjecting the web to heat setting under an applied pressure of 200 g/cm$^2$ or more.

The three parameters herein referred to, that is, specific volume, R, and S serve to characterize the entangled fibrous structure of the present nonwoven fabric in which individual fibers are highly entangled one another into a uniform and tight sheet form. The methods for measuring R and S are described below.

The bending index R of fibers in the nonwoven fabric represents the degree of looseness of the arrangement of individual fibers and is estimated by inspecting magnified photograph of the fabric surface in the following way. Five areas randomly located over the fabric surface are photographed at a suitable magnification, each area covering at least 5 mm$^2$. Any magnification may be used so far as it is sufficient to allow resolution of the individual fibers. For the sake of brevity, a magnification of 50 is assumed in the following explanation of the procedure for estimating the coefficient R. An area of 5

Figure 2:
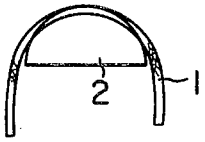
Figure 3:
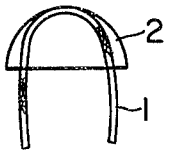
Figure 4:
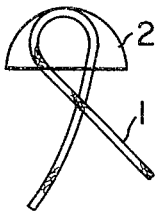

$mm^2$ of the fabric surface corresponds to an area of 125 $cm^2$ of the photograph, allowing the shape of individual fibers to be clearly shown on the photograph. A hemicircle, 1 cm in diameter, is drawn on a sheet of transparent material and laid against the fiber image, as shown in FIG. 1, to examine whether or not the bend of each fiber is enclosed within the hemicircle. In the FIG. 1 or 2, the fiber (1) crosses the arc and hence the bend is disqualified, whereas in FIG. 3 or 4 the fiber crosses the chord and hence the bend is qualified.

The bend qualified by the above test has a radius of curvature of 0.1 mm or less in the nonwoven fabric. The bending index R is expressed in terms of the number of qualified bends in a nonwoven fabric area of 1 $mm^2$. The coefficient R of the nonwoven fabric of this invention is 4 or more, indicating that 20 or more qualified bends are found within an area of 125 $cm^2$ of the photograph at a magnification of 50. R is expressed as a mean value of test results obtained from examination of 5 magnified photographs.

Another parameter S is determined by tensile tests of the nonwoven fabric performed on test specimens cut to 25 mm in width. A tensile strength measured at a gauge length of 100 mm is designated as $S_{100}$ (this is a practical tensile strength measured in accordance with JIS L 1068). Another tensile strength $S_1$ is measured at a gauge length of 1 mm. The strength efficiency S is calculated from the following equation:

$$S(\%) = \frac{S_{100}}{S_1} \times 100$$

Both $S_1$ and $S_{100}$ are expressed as a mean value from 5 tests. $S_1$ and $S_{100}$ are measured at the same deformation rate (%/minute). The data herein shown were obtained from the tensile tests carried out at an extension rate of 5 mm per minute for $S_1$ and 50 cm per minute for $S_{100}$. The value of S thus determined corresponds to a characteristic value known in the art as a strength utilization coefficient, except that the latter coefficient is determined by using $S_o$ in place of $S_1$, said $S_o$ being a tensile strength value measured at a gauge length of 0 mm. Practical measurement of $S_o$ is not able to be caried out with difficulty, because the tensile test at a gauge length of 0 mm is hardly realizable and special jaws are necessary for the purpose. Accordingly, in the present invention S is determined because of simplicity of the testing procedure.

The value of $S_1$ is practically comparable to the potential maximum strength of a nonwoven fabric and the value of S is the efficiency of the practical strength exhibited by the nonwoven fabric against the potential maximum strength. Being independent of the strength of individual fibers used in a nonwoven fabric, the value of S of the present nonwoven fabric is indicative of the degree of entanglement (tightness of entanglements) of individual fibers. The larger the S value of a nonwoven fabric, more tight is the entangled structure.

The above three structural parameters which characterize the present nonwoven fabric are indicative of the structure of assemblage or entanglement of individual fibers composing the present nonwoven fabric. The small value of specific volume means that individual fibers are closely assembled, leaving less vacancy throughout the fabric; the large value of R means that highly crumpled fibers are densely distributed throughout the nonwoven fabric; and the large value of S indicates that entanglement of fibers is tight. There has been found heretofore no nonwoven fabric having all of these three structural characteristics comparable to those of the present nonwoven fabric. Owing to such structural features, practical performance characteristics of the present nonwoven fabric are in excellent levels which have never been achieved by conventional nonwoven sheet materials.

In preferred embodiments of this invention, the product cloth has a basis weight of 100 $g/cm^2$ or more, a cantilever drape index of 200 cm//$g/cm^2$ or less, and a drape of 65% or less, indicating desirable hand characteristics; as for practical performance, it is surprising that the present nonwoven fabric withstands 5 or more cycles of laundering without revealing any deterioration in above-noted properties.

A further surprising feature of the present nonwoven fabric is brought to light by the measurement of recovery from extension. In one of the preferred embodiments of this invention, the present nonwoven fabric showed a remarkable recovery of 90% or more at an extension up to 7% and a still remarkable recovery of 95% or more at an extension below 5%. Such a high recovery has never been achieved by conventional nonwoven sheet materials and even by conventional woven fabrics. This is understandable from a high bending index in terms of R of fibers and is one of the fundamental properties associated with the structure of the present nonwoven fabric.

The present nonwoven fabric having the aforesaid structural characteristics and various properties may be manufactured from highly shrinkable fiber. The highly shrinkable fiber is obtained with synthetic fibers such as polyester fibers, acrylic fibers, polyvinyl fibers, and polypropylene fibers. Of these, a highly shrinkable polyester fiber is preferred in obtaining a nonwoven fabric having desirable practical performances including, in particular, durability. In the description given below, polyester is chiefly assumed to be used.

The present nonwoven fabric may be manufactured, for example, in the following manner:

(a) Polyester fiber having a potential shrinkage of 50% or more is formed into a web of a basis weight of 35 to 170 $g/m^2$;

(b) fine water streams under a pressure of 10 to 35 $kg/cm^2$ are discharged against the web placed on a substantially smooth surface of a supporting member having neither aperture nor pattern, thereby forming a sheet materials of a structure wherein individual fibers are intermingled and uniformly entangled one another;

(c) the resulting sheet materials is then immersed in hot water to effect areal shrinkage of 50% or more, preferably 75% or more, thereby allowing the sheet materials to become increased in density; and (d) the sheet materials with increased density is dried and heat treated at a temperature of 150° to 190° C. while being applied with a pressure of 200 $kg/cm^2$ or more in order to stabilize the fiber structure and to fix the fabric form, thus developing the structure of the present nonwoven fabric.

A highly shrinkable polyester fiber is produced, as known well, by high speed spinning, particularly at a speed of 2,700 m per minute or more. This technique easily provides a fiber having a potential shrinkage of 50% or more.

The potential shrinkage, as herein referred to, is a shrinkage in fiber length, which occurs when the fiber is heat treated under free length for one minute or more at a temperature lower than the temperature at which fibers tend to stick one another. Desirable temperatures at which the fiber is subjected to heat treatment under free length condition are 100° C. (water) or lower for polyester fibers, 140° C. (steam) or lower for acrylic fibers, and 120° C. (steam) or lower for modacrylate and polyvinyl chloride fibers.

If the potential shrinkage of individual fibers is less than 50%, it is difficult to develop sufficient area shrinkage of the sheet material and to obtain a highly entangled structure necessary for a nonwoven fabric having a specific volume of 3.5 $cm^3/g$ or less and a S value of 90% or more.

Another desirable condition for the polyester fiber to be used in the present invention is that the fiber before shrinking treatment has a crystallinity of 25% or less. The crystallinity $X_o$, as herein referred to, is given by the following equation:

$$X_o = \frac{d_c(d - d_a)}{d(d_c - d_a)}$$

where d = density of the fiber as measured by the method of density gradient tube (in this invention, the density gradient tube is prepared by mixing carbon tetrachloride and n-heptane.

$d_c$ = density of the crystalline region = 1.455

$d_a$ = density of the non-crystalline region = 1.335.

A suitable type of web for use in manufacturing the nonwoven fabric of this invention is cross-laid web or random web having preferably a basis weight of 35 to 170 $g/m^2$ in view of the basis weight of the product nonwoven fabric. Denier and cut length of the fiber forming the web are factors to be selected according to the hand and strength requirements for the product, but a desirable fiber denier is 3 denier or less in order to easily attain the requisite value of R and to produce a nonwoven fabric having a soft hand.

According to this invention, jointing of the web is effected, as described above, by entanglement of individual fibers without use of adhesives or welding, and the entanglement is effected not by stitch bonding or needle punching but by water jet treatment. Stitch bonding and needle punching have disadvantages in that injury of fiber is apt to occur; needle holes remain unclosed; intermittent action of needles is insufficient for producing uniform three-dimensional entanglement of fibers within the web having a basis weight of 170 $g/m^2$ or less; and a value of R of 4 or more is difficult to attain.

The water jet treatment used in manufacturing the present nonwoven fabric resembles those disclosed in Japanese Patent Publication No. 18,069/72 and No. 20,823/74 in that fiber entanglement is produced within a web by the action of a high-pressure water jet. However, owing to the difference in purposes of water jet treatment which are substantially opposite to each other, the technique of treatment in the present invention is basically different from the known techniques, as explained below.

The purpose of the water jet treatment carried out in manufacturing the present nonwoven fabric is to effect three-dimensional complicated entanglement of individual fibers forming a web, which is preparatory to the subsequent shrinking treatment to develop a high level of uniform entanglement. On the contrary, the treatments disclosed in the above noted Japanese Patent Publications are to develop strengths sufficient for nonwoven fabrics in one step of water jet treatment and, above all, to impact special patterns to the nonwoven fabrics.

The above-noted difference in the purpose of water jet treatment necessarily brings about different treating techniques as shown distinctly in the following two conditions for the treatment.

According to the present invention, in order to avoid formation of patterns such as apertures, ribs, and seams, the first necessary condition is to restrict the pressure of water jet within a range of from 10 to 35 $kg/cm^2$ G. If the water jet treatment is carried out under a water jet pressure above 35 $kg/cm^2$ G, ribs as described in Japanese Patent Publication No. 20,823/74 and seams as described in Japanese Patent Publication No. 13,749/73 are formed and the resulting nonwoven fabrics fail to meet the property requirements for the present nonwoven fabric.

The second condition for the water jet treatment according to this invention is to employ as the support for web a plate or roll having smooth surface. When a reticulated support is to be used, it should be of a close structure, such as a screen of finer than 100 mesh and in which the areal proportion of aperture is 10% or less. To the contrary, in the methods disclosed in Japanese Patent Publication No. 18,069/72, No. 20,823/74, or No. 7,274/61, perforated plates or screens are used as the support and basic principles of these methods are to force groups of fibers into perforations or apertures in the support, thereby effecting entanglement of fibers. In these methods, a necessary condition is to employ a special perforated plate or a coarse screen coarser than 80 mesh to meet the purpose.

The reason for avoiding formation of patterns such as apertures, ribs, and seams in the present invention is not only that specially patterned cloths find uses not in general field but necessarily in limited field, but also that an outstanding feature of the present nonwoven fabric is uniformity of texture with respect to fabric area as small as 1 $mm^2$, as described before in connection with the explanation of R, and owing to this novel feature, the present nonwoven fabric, despite its substantially even and plain texture, exhibits a desirable drape and excellent recovery from extension, as contrasted to the drape imparted by geometrical effects such as the drape of gauze cloth or crepe cloth, to cite an easily understandable example. In the case of a patterned nonwoven fabric, it is impossible to satisfy the requirement that R be 4 or more in every 1 $mm^2$ area actually inspected, and so far as ribs or apertures exist, it is very difficult to attain a specific volume of 3.5 $cm^3/g$ or less even if an increased pressure is applied during heat setting; further, even if a specific volume of 3.5 $cm^3/g$ or less is attained by application of an excessively high pressure during heat setting, the resulting nonwoven fabric is essentially different from the present nonwoven fabric as evidenced by a lower value of S compared with the present nonwoven fabric having a S-value of 90% or more.

For the above reasons, patterned nonwoven fabrics are excluded from the scope of this invention.

A sheet material obtained by fiber entanglement on application of water jet is bulky and when subjected to a stress it is prone to undergo irreversible deformation. Being so poor in dimensional stability that such a material cannot be treated as a sheet material. The specific volume of this material is in the range of 9 to 11 $cm^3/g$ which is far from a specific volume of woven fabrics of 2 to 3 $cm^3/g$. On examination, such a material reveals a structure containing a great proportion of voids unoccupied by the fiber, a low R-value of 0.5 or less, indicating insufficient bending of individual fibers, and a low S-value as low as 50% or less.

The sheet material obtained by fiber entanglement is then subjected to shrinking treatment. When polyester fibers which show 50% shrinkage on treatment with boiling water are used, the sheet material undergoes 70% areal shrinkage on treatment with boiling water, namely, the surface area becomes less than ⅓ of the initial area. It is undesirable for the uniformity of sheet structure to effect such a large deformation at a time. Consequently, it is preferred to effect stepwise deformation by treating the sheet material, for example, with water heated at 65° C., then with hot water at 80° C., and finally with boiling water.

If the sheet material is air dried after having been compacted by shrinking treatment, the resulting sheet material is found to become less bulky and less susceptible to deformation by straining as compared with the sheet material before shrinking treatment, but is fairly stiff to the touch. This sheet material approximately meets the aforesaid three structural requirements for the present nonwoven fabric: the specific volume becomes 4.5 $cm^3/g$ or less; R-value is 4 or more, indicating favorable bending of individual fibers; and S-value reaches a level of 90% or more. However, owing to unsatisfactory specific volume due to excessive voids between fibers the sheet is unsatisfactory with respect to hand characteristics including drape and softness or stiffness.

According to this invention, the sheet compacted by shrinking treatment is dehydrated, dried, and then subjected to heat setting treatment to obtain the present nonwoven fabric. Dehydration can be carried out by means of press rolls or by applying suction, or in any other way. In the subsequent drying step, care should be taken to remove the remaining water without causing any change in the shape and structure of individual fibers. Accordingly, it is desirable to avoid a drying temperature exceeding 100° C. Efficient drying under such a condition can be effected by means of a suction drum dryer or a jet drum dryer, though any other drying system can be used so long as the above-noted temperature condition is satisfied.

The heat setting of dried sheet can be carried out by means of known equipments such as hot calender roller, heat treating equipment of the Yankee dryer type, or dry decatizing equipment. The heat setting according to this invention is carried out at 150° to 190° C. under force of 200 $kg/cm^2$ or more applied in the direction normal to the fabric surface. Such heat treatment results in improvement of unsatisfactory properties of the sheet material which has undergone shrinking treatment, and thus the dense structure of the present nonwoven fabric having a specific volume of 3.5 $cm^3/g$ or more is brought to perfection. It is to be noted that the heat setting of the sheet material under a constrained condition is carried out not only to reduce the thickness by temporary compression, but to fix semi-permanently the compacted structure.

The significance of the heat setting according to this invention may become apparent by the change in crystallinity of fiber. The original fiber used as starting material has a crystallinity of 25% or less. The crystallinity of fiber in the sheet material after shrinking and drying treatments becomes about 40% and it rises to about 50% after heat setting. Thus, the microstructure of polyester fiber is stabilized and at the same time the compacted structure of fiber entanglement is also stabilized, resulting in the nonwoven fabric of this invention.

It is desirable to carry out the drying and heat setting in separate steps as described above. In the case of commercial operation where a higher operational efficiency is required, it is also feasible to carry out both treatments in single step by treating the sheet at a temperature below 190° C. under application of a straining force of 200 $g/cm^2$ or more.

In the foregoing description, the method for manufacturing a nonwoven fabric according to this invention is illustrated in detail with respect to polyester fiber as examples. Other synthetic fibers can be similarly treated by selecting proper temperatures for shrinking and heat setting in accordance with polymer characteristics of the fiber. For instance, in the case of acrylic fibers, shrinking is carried out in steam at a temperature exceeding 100° C. and heat set at a temperature below 240° C.; for polyvinyl chloride fibers, shrinking is effected by wet heat treatment at a temperature below 120° C. and heat setting temperature is below 190° C. Details are given in the following Examples.

The physical characteristics of cloth herein referred to, i.e. cantilever bending length, percentage drape, strength, and percentage recovery from extension are tested according to the methods specified in JIS L 1079–1966. Drape index, as herein referred to, is a cantilever bending length per unit basis weight of fabric and given in cm//$g/cm^2$; similarly, strength measured according to JIS is divided by unit basis weight and given in kg/cm//$g/cm^2$.

EXAMPLE 1

A typical example of the procedure for manufacturing the present nonwoven fabric and physical properties of the resulting nonwoven fabric are described below.

Unstretched polyester filaments spun at a rate of 3,100 m/minute were once wound up and then stretched to 1.4 times the original length at room temperature (about 26° C.), oiled, inserted with 8–12 crimps per inch, and cut to a length of 51 mm. The cut fiber had a size of 1.2 densier, a crystallinity of 18%, and a shrinkage in boiling water of 53%. The cut fiber was formed into a cross-laid web having a basis weight of 80 $g/m^2$. This web was pressed between rolls and then subjected to water jet treatment on a 120-mesh wire screen. The water jet treatment was carried out by use of a fluid jet nozzle provided with holes, 0.15 mm in diameter and 1 mm apart one another, and the water supply pressure was 20 $kg/cm^2$ G. The distance between the nozzle and the web was 5 cm. The wire screen supporting the web was allowed to travel at 10 m/minute. Thereafter the web was turned over, led onto a metal roll, 20 cm in diameter, and exposed to water jet from the same nozzle mounted above the roll at a distance of 4 cm. The pressure was 30 $kg/cm^2$ G. A portion of the sheet obtained was air-dried and tested for characteristic properties. The following results were obtained.

| | |
|---|---|
| Basis weight | 76 $g/m^2$ |
| Specific volume | 10.4 $cm^3/g$ |
| R | 0.2 |
| S | 41% |

After the water jet treatment, the sheet was led, while being folded, through a vessel filled with water at 60° C. and withdrawn from another end of the vessel. The sheet stayed in the vessel for 35 seconds. During this period, an areal shrinkage of 54% was completed. The shrunk sheet was then treated in another vessel filled with boiling water in the same manner as mentioned above, and again undergone an areal shrinkage of 34%. Consequently, a total of about 70% areal shrinkage took place in the above two-step treatment. The resulting shrunk sheet containing about 700% by weight of water was dehydrated to a water content of 180% by passing through a dehydrating zone provided with three pairs of press rolls. The thus dehydrated sheet was supported on a net and led to a tunnel dryer at 95°±3° C. to allow to dry to a water content of 10% or less. The dried sheet showed the following characteristics.

| | |
|---|---|
| Basis weight | 255 g/m$^2$ |
| Specific volume | 4.2 cm$^3$/g |
| R | 6.1 |
| S | 98% |

This sheet had a drape of 76% and a cantilever bending length of 138 mm. The dried sheet was passed through a pair of rolls of the duplex heating type, 300 mm in roll diameter, regulated at a temperature of 175°±1° C., while being pressed at a pressure of 0.5 kg/cm$^2$. The thus obtained sheet had the following structural and physical characteristics.

| | |
|---|---|
| Basis weight | 251 g/m$^2$ |
| Specific Volume | 3.0 cm$^3$/g |
| R | 5.8 |
| S | 98% |
| Cantilever bending length | 18 mm |
| Drape | 47% |
| Tensile strength | 295 kg/cm//g/cm$^2$ |
| Recovery from 5% extension | 98% |

EXAMPLE 2

This example is to show that the present nonwoven fabric has a structure entirely different from that of a conventional nonwoven fabric.

A cross-laid web, 35 g/m$^2$ in basis weight, was prepared from polyester fiber described in Example 1 and the web was processed in a manner similar to that described in Example 1 to obtain a nonwoven fabric of this invention. In this example, the web supported on a 120-mesh screen was exposed to water jet under a pressure of 15 kg/cm$^2$ G. Thereafter the web was transferred onto a metal roll and exposed on both sides to water jet under a pressure of 25 kg/cm$^2$ to avoid disturbance within the web caused by the water jet and to avoid formation of water jet mark on the resulting sheet. After shrinking, drying, and heat setting, the resulting nonwoven fabric showed the structural and physical characteristics shown in Table 1, column A.

For comparison, commercial polyester fiber having a fineness of 1.5 denier and a fiber length of 38 mm was formed into a web having a basis weight of 125 g/m$^2$. The web supported on a 100-mesh screen was exposed to water jet under a pressure of 35 kg/cm$^2$ from a nozzle described in Example 1, which was mounted above the screen at a distance of 5 cm. Then the water jet treatment was repeated three times alternately on both sides of the web to establish tight entanglement of individual fibers. After subsequent immersion in boiling water, drying, and heat setting, the resulting sheet showed the structural and physical characteristics shown in Table 1, column B.

For further comparison, two types of cross-laid webs, 40 g/m$^2$ and 90 g/m$^2$ in basis weight, were formed from polyester fiber described in Example 1. Each web was needle-punched at a hole density of 55 holes/cm$^2$ by means of a punch having a needle density of 2.1 needles/cm$^2$. Both punched sheets had poor appearance and extrusion of fiber bundles from the back side of the sheet was marked after final punching. Particularly, the needle-punched sheet from the web having a basis weight of 40 g/m$^2$ was easily deformed on application of a small external force, indicating poor effect of needle punching. Both sheets were subjected to shrinking, drying, and heat setting treatments in the same manner as mentioned above. Although the areal shrinkage amounted to about 70% and the heat setting was effected by hot calendering at an applied pressure of 0.5 kg/cm$^2$ G, both of the resulting sheets showed surface irregularities corresponding to punched holes and extruded fiber bundles were seen on the back as unfavorable clusters of fluffs. The structural and physical properties of the sheet obtained from the webs, 40 g/m$^2$ and 90 g/m$^2$ in basis weight, were as shown in Table 1, columns C and D, respectively.

Table 1

| | A | B | C | D |
|---|---|---|---|---|
| basic weight, g/m$^2$ | 120 | 117 | 144 | 328 |
| Thickness, mm | 0.267 | 0.607 | 1.191 | 2.820 |
| Specific volume, cm$^3$/g | 3.2 | 7.1 | 8.2 | 8.6 |
| R-value | 5.0 | 0.8 | 2.7 | 3.0 |
| S-value, % | 95 | 56 | 35 | 32 |
| Cantilever bending length, | 16 | 53 | 21 | 49 |
| Drape, % | 41 | 84 | 50 | 77 |
| Tensile strength, kg/cm//g/cm$^2$ | 302 | 480 | 54 | 51 |
| Recovery from 5% extension, % | 97 | 25 | 89 | 87 |

EXAMPLE 3

This example is to show a method for manufacturing a nonwoven fabric according to this invention from acrylic fiber.

A wet tow of acrylic filaments obtained by wet spinning and wet stretching according to the customary manufacturing process was cut to a length of 25 mm and introduced into an aqueous solution, at 25° C., containing 3 g/liter of polyethylene oxide. The cut two disintegrated into individual fibers, forming a uniform dispersion in the aqueous solution. By using a 45-mesh screen, the dispersed fibers were carefully formed into a random web having a basis weight of 60 g/m$^2$. On examination of a portion of the web after drying, it was found that the fiber has a fineness of 1.3 denier, a tenacity of 4.6 g/d, an elongation of 12%, a linear shrinkage of 29% on immersion in boiling water and 62% on subsequent exposure to a steam atmosphere at 140° C.

The web was subjected to water jet treatment by use of the same equipment and under the same conditions as used in Example 1. The treated web was introduced into a bath tub filled with boiling water and allowed to shrink for 70 seconds. Thereafter the shrunk web was air-dried. The air-dried sheet was again subjected to shrinking treatment with steam at 140° C. for 3 minutes in a steam treating equipment. The sheet showed an areal shrinkage of 72% in total after the above two treatments with boiling water and with steam. The resulting sheet was unsatisfactory in appearance because of a high degree of surface irregularities and creases. In addition, the sheet was stiff to the touch.

By using an ordinary domestic hand iron, the sheet was strongly ironed under a current of steam. On this treatment, surface irregularities and creases disappeared and stiffness was reduced and there was obtained a nonwoven fabric with desirable drape. The structural and physical characteristics of the resulting nonwoven fabric were as shown below.

| | |
|---|---|
| Basis weight | 242 g/m$^2$ |
| Thickness | 0.847 mm |
| Specific volume | 3.5 cm$^3$/g |
| R | 4.4 |
| S | 91.2% |
| Cantilever bending length | 32 mm |
| Drape | 57% |
| Strength | 465 kg/cm//g/cm$^2$ |

EXAMPLE 4

This example is to show a procedure for manufacturing a nonwoven fabric according to this invention from polyvinyl chloride fiber and also to show how important are the shrinking treatment and heat setting in manufacturing a nonwoven fabric according to this invention.

By using a webber in which air-borne fiber is trapped by a screen, a random web having a basis weight of 120 g/m$^2$ was formed from commercial polyvinyl chloride fiber having a fineness of 2 denier and a fiber length of 51 mm. This polyvinyl chloride fiber showed a lengthwise shrinkage of 32% on immersion in hot water and of 55% on subsequent exposure to steam at 120° C. The web was supported on a 200-mesh wire screen and exposed to water jet discharged under a pressure of 30 kg/cm$^2$ G from the same nozzle as used in Example 1, which was mounted above the screen at a distance of 5 cm. During the treatment, the 100-mesh wire screen used as the support was allowed to travel at a rate of 15 m/minute. The waste water was removed by means of a suction mechanism beneath the wire screen. Thereafter the back side of the web was exposed to water jet at a pressure of 35 kg/cm$^2$ G. Such a treatment was repeated three times on both sides of the web. A portion of the resulting sheet was air-dried and tested for structural and physical characteristics. The results obtained were as shown in Table 2, column E.

After the water jet treatment, the sheet was immersed in boiling water to allow to shrink. The areal shrinkage was about 50%. The shrunk sheet was dehydrated in a centrifugal dehydrator to a water content of about 120%. The dehydrated sheet was then exposed to a steam atmosphere at 120° C. for 10 minutes to be imparted with an areal shrinkage of 35%. Consequently, total areal shrinkage amounted to 77%. The resulting sheet had structural and physical characteristics shown in Table 2, column E.

After the shrinking treatment, the sheet was subjected to intensive ironing for more than 10 minutes over the surface with superposed medical gauze by using a domestic iron regulated at a temperature of 170°±2° C. to effect heat setting. The resulting nonwoven fabric met the structural requirements according to this invention, although it was a little deficient in hand with respect to softness. The structural and physical characteristics were as shown in Table 2, column G.

Table 2

| | E | F | G |
|---|---|---|---|
| Basis weight, g/m$^2$ | 108 | 461 | 457 |
| Thicknness, mm | 1.11 | 2.03 | 1.42 |
| Specific volume, cm$^3$/g | 10.3 | 4.4 | 3.1 |
| R | 1.1 | 4.8 | 4.8 |
| S, % | 38.0 | 92.7 | 94.1 |
| Cantilever bending length, mm | 47 | 38 | 32 |
| Drape, % | 85 | 53 | 49 |
| Tensile strength, kg/cm//g/cm$^2$ | 426 | 306 | 320 |
| Recovery from 5% extension, % | 19 | 98 | 99 |

What is claimed is:

1. A nonwoven, non-needle punched fabric having a uniform texture and no pattern and composed of discontinuous 100% synthetic fiber wherein said fiber is initially characterized by having a potential shrinkage of 50% or more, and wherein individual highly crumpled fibers are held together by a tight three dimensional entanglement into a stabilized sheet form without containing any adhesive bonds or melt fiber bonds; wherein said non-woven fabric has a specific volume of 3.5 cm$^3$/g or less; wherein said fabric has on the average 4.0 or more bent individual fibers with a radius of curvature equal or less than 0.1 mm per square millimeter; and wherein said fabric has a basis weight of 100–520 g/m$^2$.

2. A nonwoven fabric according to claim 1, wherein the synthetic fiber is polyester fiber.

3. A non-woven fabric as claimed in claim 2 wherein said polyester fiber is characterized by initially having a crystallinity of 25% or less.

4. A non-woven fabric as claimed in claim 1 wherein said fiber is acrylic fiber.

5. A non-woven fabric as claimed in claim 1 wherein said fiber is polyvinyl chloride.

6. A non-woven fabric as claimed in claim 1 wherein said fiber is polypropylene fiber.

* * * * *